US007463844B2

(12) United States Patent
Hashimoto et al.

(10) Patent No.: US 7,463,844 B2
(45) Date of Patent: Dec. 9, 2008

(54) PROCESS CARTRIDGE THAT SPACES A DEVELOPING ROLLER AND PHOTOSENSITIVE DRUM FROM EACH OTHER AND IMAGE FORMING APPARATUS USABLE THEREWITH

(75) Inventors: Koji Hashimoto, Shizuoka-ken (JP); Kazuhiko Kanno, Odawara (JP); Yasuhiko Fuse, Numazu (JP); Satoshi Murasaki, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 299 days.

(21) Appl. No.: 11/374,207

(22) Filed: Mar. 14, 2006

(65) Prior Publication Data

US 2007/0071495 A1 Mar. 29, 2007

(30) Foreign Application Priority Data

Mar. 18, 2005 (JP) ..... 2005-078770

(51) Int. Cl.
*G03G 21/16* (2006.01)

(52) U.S. Cl. ..... 399/111; 399/113

(58) Field of Classification Search ..... 399/111, 399/113

See application file for complete search history.

(56) References Cited

U.S. PATENT DOCUMENTS

| | | | | |
|---|---|---|---|---|
| 5,740,500 | A | 4/1998 | Hashimoto | 399/114 |
| 5,768,658 | A | 6/1998 | Watanabe et al. | 399/111 |
| 5,815,644 | A | 9/1998 | Nishiuwatoko et al. | 399/113 |
| 5,870,655 | A | 2/1999 | Nishiuwatoko et al. | 399/111 |
| 5,893,006 | A | 4/1999 | Kanno et al. | 399/13 |
| 5,923,924 | A | 7/1999 | Hashimoto | 399/111 |
| 5,926,666 | A | 7/1999 | Miura et al. | 399/25 |
| 5,937,240 | A | 8/1999 | Kanno et al. | 399/111 |
| 5,940,657 | A | 8/1999 | Yokomori et al. | 399/119 |
| 5,950,049 | A | 9/1999 | Yokomori et al. | 399/119 |
| 6,072,969 | A | 6/2000 | Yokomori et al. | 399/119 |
| 6,101,352 | A | 8/2000 | Hashimoto et al. | 399/119 |

(Continued)

FOREIGN PATENT DOCUMENTS

EP 1 510 888 A 3/2005

(Continued)

OTHER PUBLICATIONS

European Search Report for Application No. EP 06111256.1-1240 issued Apr. 4, 2007.

*Primary Examiner*—David M Gray
*Assistant Examiner*—Ruth N Labombard
(74) *Attorney, Agent, or Firm*—Fitzpatrick, Cella, Harper & Scinto

(57) ABSTRACT

A cartridge detachably mountable to a main assembly of an electrophotographic image forming apparatus. The apparatus includes movable first and second engageable members. The cartridge includes an electrophotographic photosensitive drum, a developing roller, a first force receiving portion for receiving, from the first engageable member, a force for separating the drum and roller, a second force receiving portion for keeping the drum and roller spaced from each other and for receiving a force, from the second engageable member, for separating the first engageable member and the first force receiving portion. When the cartridge is transported while being in a mounted state, the second force receiving portion receives a force for separating the first engageable member and the first force receiving portion from each other from the second engageable member.

10 Claims, 9 Drawing Sheets

U.S. PATENT DOCUMENTS

| | | | | |
|---|---|---|---|---|
| 6,151,459 | A | 11/2000 | Hashimoto et al. | 399/27 |
| 6,246,853 | B1 | 6/2001 | Suzuki et al. | 399/262 |
| 6,385,420 | B1 | 5/2002 | Morioka | 399/174 |
| 6,496,667 | B2 | 12/2002 | Shiratori et al. | 399/103 |
| 6,665,507 | B1 | 12/2003 | Hooper, III et al. | 399/110 |
| 6,681,088 | B2 | 1/2004 | Kanno et al. | 399/111 |
| 6,735,403 | B2 | 5/2004 | Kanno et al. | 399/103 |
| 6,834,173 | B2 | 12/2004 | Yamaguchi et al. | 399/119 |
| 6,937,834 | B2 | 8/2005 | Kanno et al. | 399/114 |
| 6,947,687 | B2 | 9/2005 | Yamaguchi et al. | 399/111 |
| 6,961,528 | B2 | 11/2005 | Yamaguchi et al. | 399/119 |
| 6,980,759 | B2 | 12/2005 | Kanno et al. | 399/111 |
| 7,027,754 | B2 | 4/2006 | Harada et al. | 399/111 |
| 7,058,337 | B2 | 6/2006 | Hashimoto et al. | 399/111 |
| 7,184,686 | B2 | 2/2007 | Kanno et al. | 399/111 |
| 2005/0025522 | A1 | 2/2005 | Tsuzuki et al. | 399/111 |
| 2005/0047822 | A1 | 3/2005 | Hashimoto et al. | 399/111 |
| 2005/0069342 | A1* | 3/2005 | Kanno et al. | 399/111 |
| 2006/0147225 | A1 | 7/2006 | Harada et al. | 399/111 |

FOREIGN PATENT DOCUMENTS

| | | | |
|---|---|---|---|
| EP | 1 519 248 | A | 3/2005 |
| JP | 07-104637 | A | 4/1995 |
| JP | 7-104637 | A | 4/1995 |
| JP | 2000-275933 | A | 10/2000 |
| JP | 2001-117467 | A | 4/2001 |
| JP | 2002-006722 | A | 1/2002 |
| JP | 2002-174952 | A | 6/2002 |
| JP | 2004-78212 | A | 3/2004 |
| JP | 2005-55579 | A | 3/2005 |
| JP | 2005-99517 | A | 4/2005 |

* cited by examiner (a)

(b)

PROCESS CARTRIDGE THAT SPACES A DEVELOPING ROLLER AND PHOTOSENSITIVE DRUM FROM EACH OTHER AND IMAGE FORMING APPARATUS USABLE THEREWITH

FIELD OF THE INVENTION AND RELATED ART

The present invention relates to a process cartridge, and an electrophotographic image forming apparatus employing a process cartridge.

Here, an electrophotographic image forming apparatus means an apparatus which forms an image on a recording medium using an electrophotographic image forming method. For example, it includes an electrophotographic copying machine, an electrophotographic printer (for example, laser beam printer, LED printer, etc.), a facsimileing machine, a wordprocessor, etc.

A process cartridge means a cartridge in which an electrophotographic photosensitive member, and at least a developing means as a processing means which acts on the electrophotographic photosensitive member, are integrally disposed, and which is removably mountable in the main assembly of an electrophotographic image forming apparatus.

In the field of an electrophotographic image forming apparatus employing an electrophotographic image formation process, a system in which an electrophotographic photosensitive member, and a single or multiple processing means which act on the electrophotographic photosensitive member, are integrated into a unit which is removably mountable in the main assembly of an electrophotographic image forming apparatus has been used.

The main assembly of an image forming apparatus, and a unit which is removably mountable in the main assembly, are packaged for distribution. As the method for packaging them, there have been known the method for individually packaging them in their own boxes, and the method for packaging them together in a single box. In either case it is when the image forming apparatus is used for the first time that the unit is mounted into the main assembly of an image forming apparatus. As the unit is mounted into the main assembly, it is properly positioned relative to the main assembly.

Thus, in order to improve an image forming apparatus in terms of the efficiency with which an image forming apparatus main assembly, and a unit to be mounted therein, are distributed, there have been made various proposals for reducing in size the box in which the main assembly and unit are packaged, individually or together. According to these proposals, the main assembly and unit are to be packaged in a single box, with the unit mounted in the main assembly. Regarding these proposals, Japanese Laid-open Patent Application 7-104637 discloses an image forming apparatus comprising a unit mounting first means for mounting a unit into the position in which the unit is to form an image, and holding therein, and a unit mounting second means for mounting the unit into the position different from the position in which the unit is to form an image, and holding therein.

SUMMARY OF THE INVENTION

In the past, while an image forming apparatus was shipped in a single box, with its unit mounted in its main assembly, the portions of the main assembly, which are for transmitting driving force to the unit, the portions of the unit, which are for receiving the driving force from the main assembly, and the portion of its photosensitive drum (electrophotographic photosensitive member), which is kept in contact with its transfer roller, and the portion of the transfer roller, which is kept in contact with the photosensitive drum, were subjected to vibrations and shocks. Thus, the measures for dealing with these vibrations and shocks have long been desired.

Thus, the primary object of the present invention is to provide an electrophotographic image forming apparatus and a process cartridge, which are capable of protecting the electrophotographic photosensitive drum and development roller while the image forming apparatus and process cartridge are transported, with the process cartridge mounted in the main assembly of the image forming apparatus.

Another object of the present invention is to provide an electrophotographic image forming apparatus and a process cartridge, which are capable of protecting the force catching portion for catching the force for separating the electrophotographic photosensitive drum and development roller from each other, and the first retaining portion for keeping the electrophotographic photosensitive drum separated from each other, while the image forming apparatus and process cartridge are transported, with the process cartridge mounted in the main assembly of the image forming apparatus.

Another object of the present invention is to provide an electrophotographic image forming apparatus, the main assembly of which is no larger the main assembly of an image forming apparatus in accordance with any of the prior arts, and which can be transported with a process cartridge mounted in its main assembly, being therefore smaller in the amount of packaging supplies necessary for its transportation, and greater in transportation efficiency, and a process cartridge which can be transported in the main assembly of an electrophotographic image forming apparatus.

Another object of the present invention is to provide a process cartridge and an electrophotographic image forming apparatus, which make it possible to reliably carrying out an operation for separating the charge roller from the photosensitive drum, and an operation for separating the development roller from the photosensitive drum, independently from each other, in a short time, while the process cartridge remains in the main assembly of the image forming apparatus.

Another object of the present invention is to provide a process cartridge which makes it possible to separate the charging member from the photosensitive drum even while the process cartridge remains in the main assembly of an electrophotographic image forming apparatus, and an electrophotographic image forming apparatus compatible with such a process cartridge.

According to an aspect of the present invention, there is provided a process cartridge detachably mountable to a main assembly of an electrophotographic image forming apparatus, the apparatus including a first engageable member movable between a first position and a second position retracted from the first position and a second engageable member movable between a third position and a fourth position retracted from the third position, said process cartridge being transportable while being in a mounted state in the main assembly of the electrophotographic image forming apparatus, said process cartridge comprising an electrophotographic photosensitive drum; a developing roller for developing an electrostatic latent image formed on said electrophotographic photosensitive drum; a first frame supporting said electrophotographic photosensitive drum; a second frame supporting said developing roller, said second frame being movably connected with said first frame; a first force receiving portion for receiving, from the first engageable member, a force for separating said electrophotographic photosensitive drum and said developing roller from each other by contacting to the first engageable member, when said process cartridge is mounted to the main assembly of the electrophotographic image forming apparatus, and the first engageable member is placed at the first position; a second force receiving portion for keeping said electrophotographic photosensitive drum and said developing roller spaced from each other and for receiving a force, from the second engageable member, for separating the first engageable member and said first force receiving portion from each other by contacting to said engageable member when said process cartridge is mounted to the main assembly of the electrophotographic image forming apparatus, and the second engageable member is placed that said third position; wherein when said process cartridge is transported while being in a mounted state in said main assembly of the electrophotographic image forming apparatus, said second force receiving portion receives a force for separating the first engageable member and said first force receiving portion from each other from the second engageable member.

According to another aspect of the present invention, there is provided an electrophotographic image forming apparatus for forming an image on a recording material to which a process cartridge is detachably mountable, wherein electrophotographic image forming apparatus is transportable with the process cartridge mounted thereto, said apparatus comprising (1) a first engageable member movable between a first position and a second position retracted from the first position; (2) a second engageable member movable between a third position and a fourth position retracted from the third position; (3) a mounting member for demountably mounting said process cartridge; a process cartridge mounted to said mounting member, said process cartridge including, an electrophotographic photosensitive drum a developing roller for developing an electrostatic latent image formed on said electrophotographic photosensitive drum; a first frame supporting said electrophotographic photosensitive drum; a second frame supporting said developing roller, said second frame being movably connected with said first frame; a first force receiving portion for receiving, from the first engageable member, a force for separating said electrophotographic photosensitive drum and said developing roller from each other by contacting to the first engageable member, when said process cartridge is mounted to the main assembly of the electrophotographic image forming apparatus, and the first engageable member is placed at the first position; a second force receiving portion for keeping said electrophotographic photosensitive drum and said developing roller spaced from each other and for receiving a force, from the second engageable member, for separating the first engageable member and said first force receiving portion from each other by contacting to said engageable member when said process cartridge is mounted to the main assembly of the electrophotographic image forming apparatus, and the second engageable member is placed that said third position; wherein when said process cartridge is transported while being in a mounted state in said main assembly of the electrophotographic image forming apparatus, said second engageable member is placed at said third position.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

First, the process cartridge in this embodiment, and the electrophotographic image forming apparatus in which the process cartridge in this embodiment is removably mountable, will be described, with reference to the appended drawings.

Hereafter, the preferred embodiments of the present invention will be described with reference to electrophotographic image forming apparatuses (which hereinafter will be simply referred to as "image forming apparatuses") which form an image on an electrophotographic photosensitive member, using an electrophotographic image forming process, and process cartridges (which hereinafter will be referred to simply as "cartridge") which are removably mountable in any of the abovementioned image forming apparatuses.

In the following descriptions of the preferred embodiments, the "lengthwise direction" of a cartridge means the direction perpendicular (roughly perpendicular) to the direction in which a cartridge is mounted into, or removed from, the main assembly of an image forming apparatus (which hereinafter will be referred to simply as "apparatus main assembly"). It is also perpendicular (roughly perpendicular) to the direction in which a recording medium is conveyed through the main assembly.

(General Structure of Image Forming Apparatus)

Figure 1:
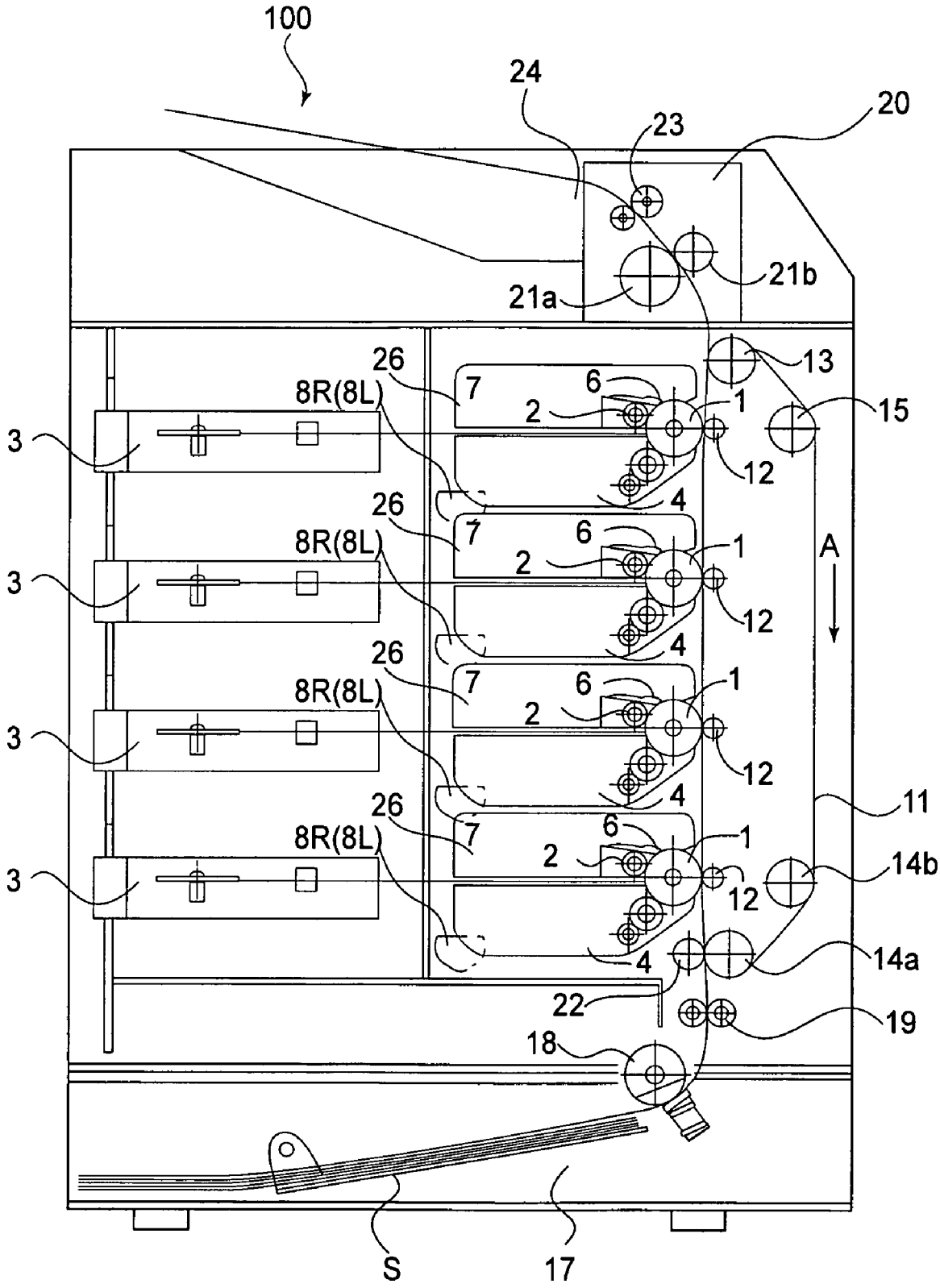
FIG. 1 is a schematic sectional view of the electrophotographic color image forming apparatus in the first embodiment of the present invention, showing the general structure thereof.

First, referring to FIG. 1, the general structure of the image forming apparatus will be described along with the image forming operation of the image forming apparatus. FIG. 1 is a schematic sectional view of the image forming apparatus, in this embodiment, which is holding the cartridges in accordance with this embodiment, in their proper positions.

Figure 9:
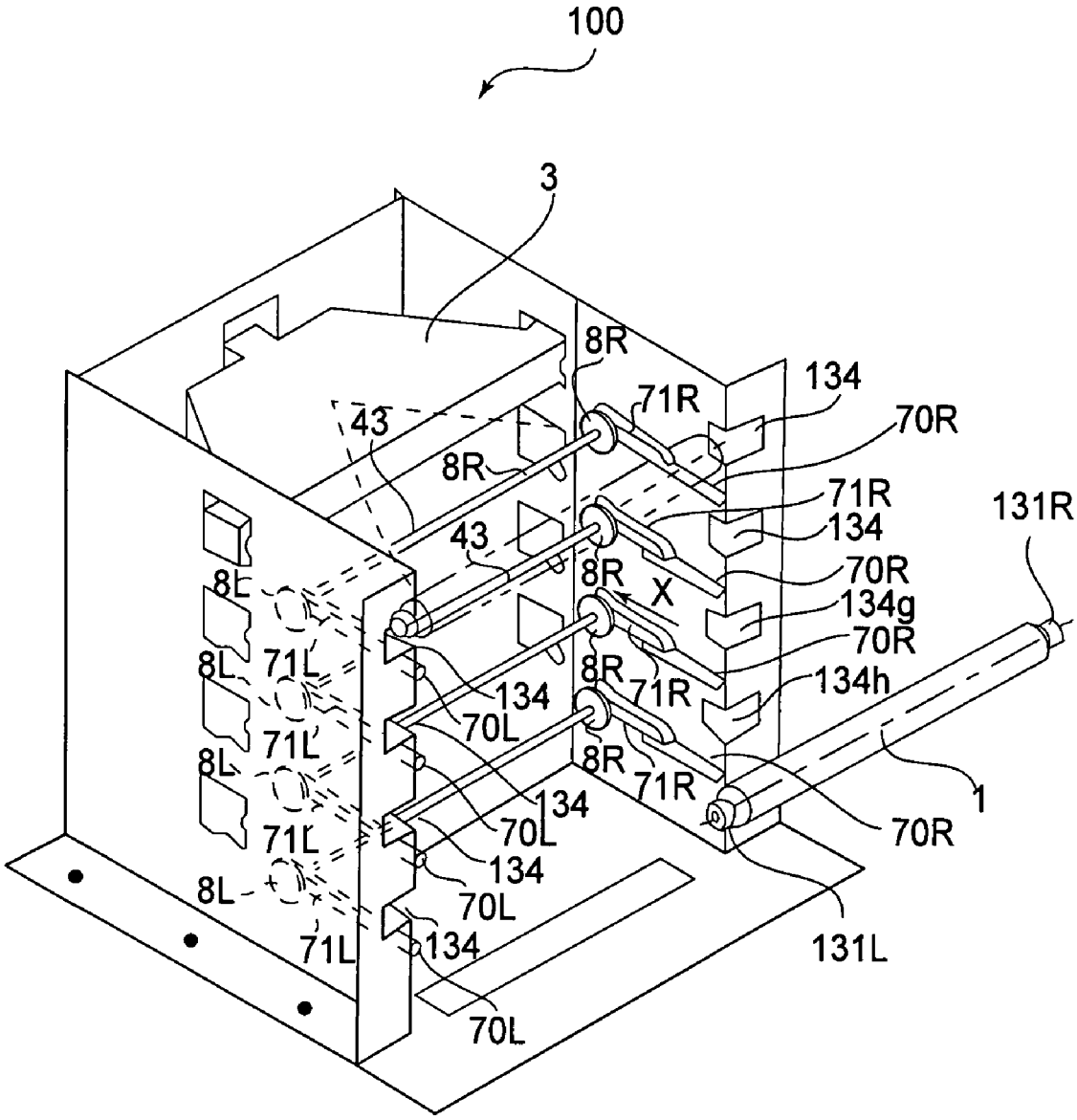
FIG. 9 is a partially phantom perspective view of the main assembly of the electrophotographic color image forming apparatus in the first embodiment.

Referring to FIGS. 1 and 9, the image forming apparatus in this embodiment has four cartridge bays (70R, 70L, 71R, and 71L) in each of which a cartridge 7 is mounted. The four bays are vertically stacked in parallel. The image forming apparatus also has four image forming stations which also are vertically stacked, corresponding in position to the four cartridge bays, one for one. The four image forming stations form yellow, magenta, cyan, and black toner images, respectively, listing from the bottom side. The four image forming stations are different in the color of the images they form, but are the same in structure.

In each of the image forming stations, a monochromatic image is formed of toner, on a photosensitive drum 1, which is an electrophotographic photosensitive member in the form of a drum, using a process in which the photosensitive drum 1 is exposed to an optical image (photosensitive drum 1 is exposed to a beam of laser light projected from an optical system onto photosensitive drum 1 while being modulated with image formation data). In synchronism with the progression of the formation of the toner image, a recording medium S, such as a sheet of recording paper, OHP, or the like, is fed into the apparatus main assembly from a cassette 17, by a separating-feeding roller 18, and then, is conveyed further through the main assembly, by a pair of conveyance rollers 19, a conveyer belt 11, etc.

The abovementioned conveyer belt 11 opposes all of the photosensitive members 1, and circularly moves in contact with all the photosensitive members 1. It is formed of film. It is stretched around four rollers, which are a driver roller 13, a pair of follower rollers 14*a* and 14*b*, and a tension roller 15, and circularly moves in the direction indicated by an arrow mark A in FIG. 1. The recording medium S is conveyed by the conveyer belt 11 to each of the four image transfer locations, in which bias is applied to a transfer roller 12 as an image transferring means, whereby the toner image on the photosensitive drum 1 is transferred onto the recording medium S. After the transfer, the recording medium S is conveyed to a fixing means 20, which has a driving roller 21*a*, and a fixation roller 21*b* which contains a heater. Then, the recording medium S is conveyed through the fixing means 20. While the recording medium S is conveyed through the fixing means 20, heat and pressure is applied to the recording medium S and the toner image thereon, fixing thereby the toner image to the recording medium S. Thereafter, the recording medium S is discharged by a pair of discharge rollers 23, into a delivery tray 24.

Figure 2:
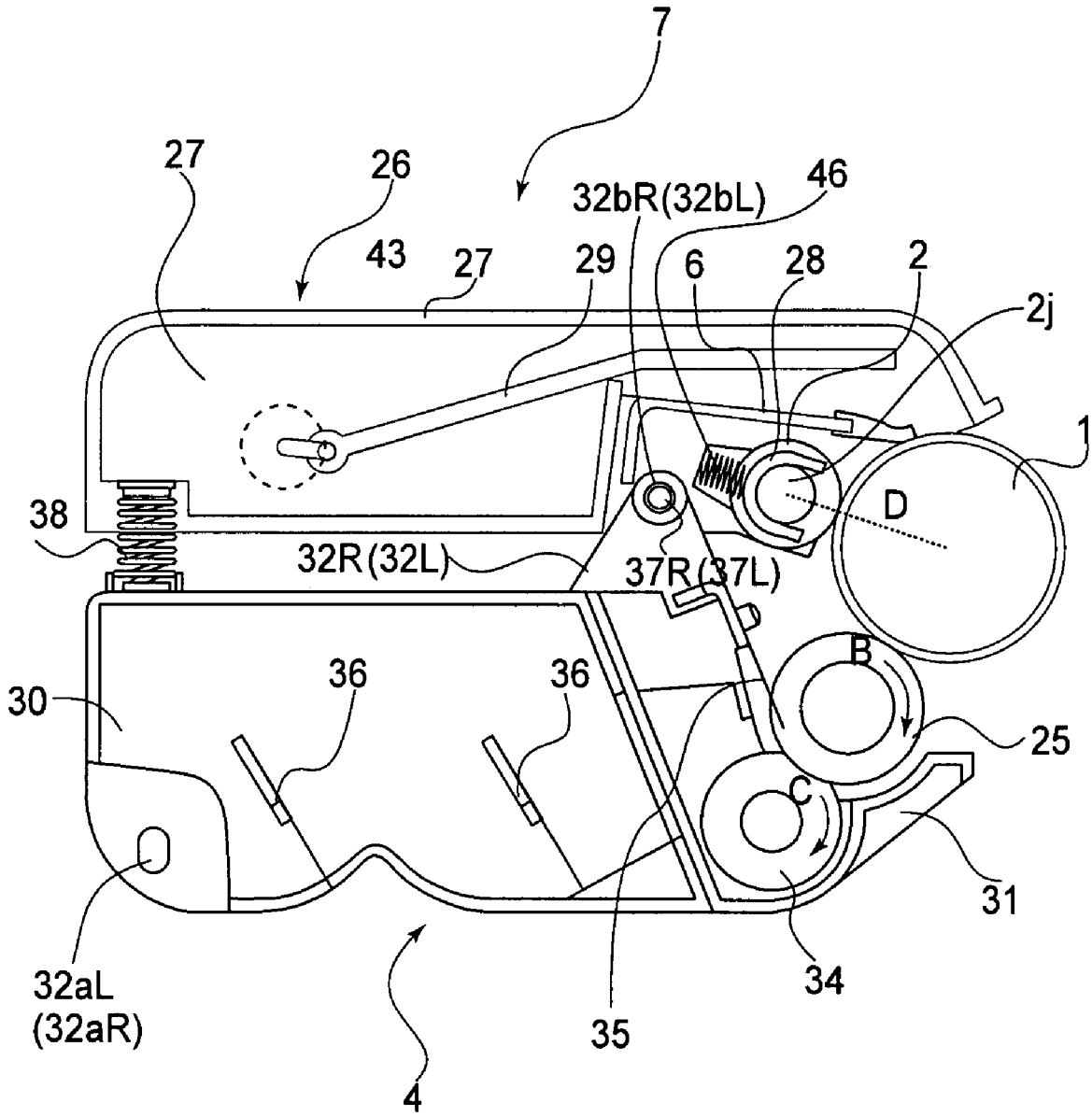
FIG. 2 is a sectional view of the cartridge in the first embodiment, showing the general structure thereof.

While the cartridge 7 is out of the apparatus main assembly, the development roller 25 remains always in contact with the photosensitive drum 1 (FIG. 2). The cartridge 7 is to be mounted into the apparatus main assembly 100 (in direction indicated by arrow mark X in FIG. 9) so that a pair of bearings 131*a* and 131*b*, by which the photosensitive drum 1 is supported, are guided inward of the apparatus main assembly 100 by a pair of guide grooves 134*a* (134*b*, 134*c*, or 134*d*) and 134*e* (134*f*, 134*f*, or 134*h*), respectively. After the mounting of the cartridge 7 into the apparatus main assembly 100, the photosensitive drum 1 and development roller 25 are separated from each other by a pair of development roller separating members 8R and 8L as a means for pivotally moving the development unit of the process cartridge 7. The development roller separating members 8R and 8L will be described later in detail.

(General Structure of Cartridge)

The cartridge 7 is removably mountable in the image forming apparatus main assembly 100. It has at least an electrophotographic photosensitive drum, a charging means for charging the electrophotographic photosensitive drum, and a developing means for developing a latent image formed on the electrophotographic photosensitive drum.

Referring to FIG. 2, in the cartridge 7 in this embodiment, the photosensitive drum 1 provided with a photosensitive layer is rotated, the peripheral surface of the photosensitive drum 1 is uniformly charged by a charge roller 2 as the charging means, across the area which opposes the charge roller 2. The charged portion of the peripheral surface of the photosensitive drum 1 is exposed to an optical image projected from the optical system 3 of the image forming apparatus. As a result, an electrostatic latent image is formed on the exposed area of the peripheral surface of the photosensitive drum 1. Meanwhile a layer of toner is formed in uniform thickness, on the peripheral surface of the development roller 25 by a development blade 35 of the developing means. Thereafter, the toner is transferred onto the peripheral surface of the photosensitive drum 1 in the pattern of the latent image, developing thereby the latent image into a visible image, that is, an image forming of toner. Then, the toner image is transferred onto the recording medium S by the transfer roller 12. The toner remaining on the photosensitive drum 1 is removed by the cleaning blade 6 of a cleaning means.

The cartridge 7 is made up of two distinctive units: a photosensitive member unit 26 comprising the photosensitive drum 1, charge roller 2, and cleaning blade 6, and a development unit 4 comprising the developing means.

To a first frame, which is the cleaning means frame 27 of the photosensitive member unit 26, the photosensitive drum 1 is rotatably attached, with a pair of bearings (unshown) placed between the photosensitive drum 1 and the cleaning means frame 27. With the peripheral surface of the photosensitive drum 1, the charger roller 2 and cleaning blade 6 are in contact, as described above. After being removed from the peripheral surface of the photosensitive drum 1 by the cleaning blade 6, the residual toner is sent by a toner conveying mechanism 29 to a chamber 27*a* provided for the removed residual toner, in the rear portion of the cleaning means frame 27.

To the cleaning means frame 27 as a first frame of the photosensitive member unit 26, a pair of charge roller bearings 28 are attached, being enabled to move in the direction indicated by a line D which connects the rotational axis of the charge roller 2 and the rotational axis of the photosensitive drum 1. The rotational axle 2*j* of the charge roller 2 is rotatably borne by the pair of bearings 28, and the bearings 28 are kept pressed toward by photosensitive drum 1 by a pair of charge roller pressing members 26. Thus, the charge roller 2 remains pressed upon the photosensitive drum 1.

The development unit 4 has the development roller 25 which rotates in the direction indicated by an arrow mark B in FIG. 2 while remaining in contact with the photosensitive drum 1, and a second frame (30, 31, 32R, and 32L). The second frame comprises: a toner container 30 in which toner is stored; a developing means frame 31; and a pair of side covers 32R and 32L. The development roller 25 is rotatably supported at both of its lengthwise ends, by the lengthwise ends of the developing means frame 31. With the peripheral surface of the development roller 25, a toner supply roller 34 and a development blade 35 are in contact. The toner supply roller 34 rotates in the direction indicated by an arrow mark C while remaining in contact with the development roller 25. The development blade 35 is for regulating the layer of toner formed on the peripheral surface of the development roller 25. In the toner container 30, a toner conveying mechanism 36 is disposed for conveying the toner in the toner container 30, to the abovementioned toner supply roller 34 while stirring the toner.

The development unit 4 and photosensitive member unit 23 are attached to each other so that as the cartridge 7 is mounted into the apparatus main assembly 100, the development unit 4 is positioned as if it were suspended from the photosensitive member unit 26, being allowed to pivotally move relative to the photosensitive member unit 26. That is, the development unit 4 is attached to the photosensitive member unit 26, with a pair of shafts 37R and 37L fitted in the center holes 32*b*R and 32*b*L of the side covers 32R and 32L, so that after the mounting of the cartridge 7 into the apparatus main assembly 100, the development unit 4 is allowed to pivot about the shafts 37R and 37L (axial lines of holes 32*b*R and 32*b*L).

In order to ensure that during an image forming operation, the development roller 25 is kept in contact with the photosensitive drum 1 by the moment of the development unit 4 about the shafts 37R and 37L (about axial lines thereof), the development unit 4 is kept pressed by a pair of compression springs 38 as pressure applying members.

In other words, the cartridge 7 in this embodiment is structured to allow the development unit 4 to freely pivot about the shafts 37R and 37L so that the angle of the development unit 4 relative to the photosensitive unit 26 can be changed to place the cartridge 7 into a first or second state of separation. The first state of separation is a state in which the development roller 25 remains separated from the photosensitive drum 1. This state is necessary to extend the cartridge 7 in life by keeping the development roller 25 separated from the photosensitive drum 1 while their involvement is not necessary for image formation.

The second state of separation is a state in which not only are the development roller 25 and charge roller 2 kept separated from the photosensitive drum 1, but also, the development roller separating member 8R and 8L and force catching first portion 32*a*R and 32*a*L are kept separated. The second state of separation is necessary to prevent the cartridge 7 and apparatus main assembly 100 from sustaining damage or breaking down, by ensuring that there will be no unnecessary contact while the image forming apparatus is transported, with the cartridge 7 left mounted in the apparatus main assembly 100.

Figure 3:
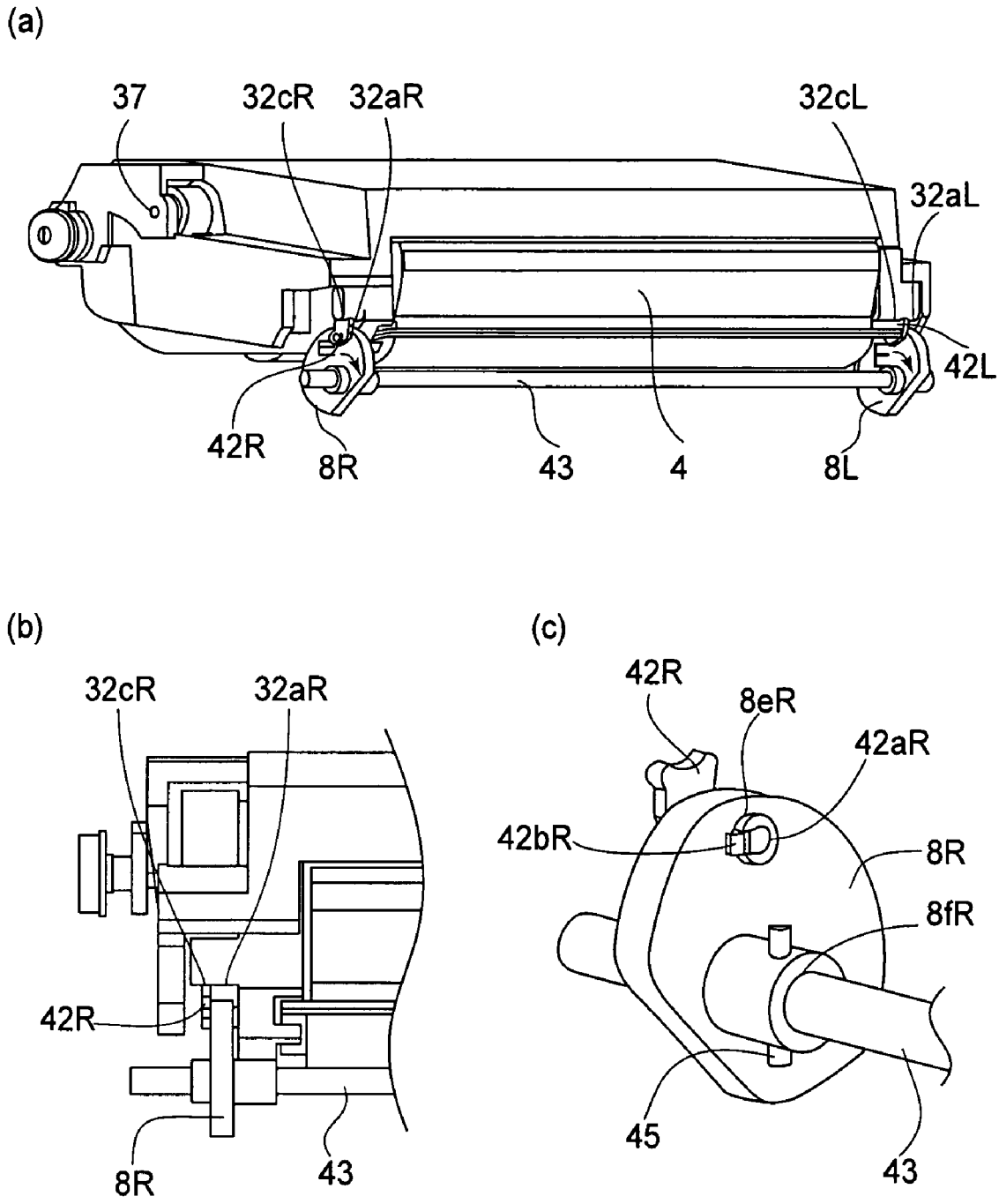
FIG. 3 is a perspective view of the cartridge in the first embodiment, showing the mechanism for separating the developing member and charging member from the photosensitive drum.

Referring to FIG. 3, the side covers 32R and 32L of the development unit 4 are provided with a pair of force catching second portions 32*c*R and 32*c*L, and the pair of force catching first portions 32*a*R and 32*a*L. The force catching second portions 32*c*R and 32*c*L are the portions by which the development unit 4 catches from the apparatus main assembly 100, the force that puts the cartridge 7 into the second state of separation, and the force catching first portions 32*a*R and 32*a*L are the portions by which the development unit 4 catches from the apparatus main assembly 100, the force that puts the cartridge 7 into the first state of separation.

In the case of a developing method of the contact type, that is, the developing method in which a latent image is developed by placing the development roller 25 in contact with the photosensitive drum 1, the photosensitive drum 1 is desired to be a rigid component, whereas the development roller 25 is desired to be an elastic roller, that is, a roller having an elastic layer. As the material for this elastic layer, solid rubber or the like is usable. In consideration of the function of the development roller 25, which is to charge the toner, the peripheral surface of the solid rubber layer of the development roller 25 may be coated with resin or the like.

(Means for Separating and Keeping Separated Developing Member and Charging Member from Photosensitive Drum)

Next, referring to FIGS. 3 and 4, the means for separating and keeping separated the development roller 25 and charge roller 2 from the photosensitive drum 1, in the cartridge 7 in this embodiment, will be described.

As described above, the cartridge 7 in this embodiment is designed so that it can be put into the second state of separation, in which the development roller 25 and charge roller 2 are not in contact with the photosensitive drum 1, and the first state of separation, in which only the development roller 25 is not in contact with the photosensitive drum 1. Referring to FIG. 3, the development roller separating members 8R and 8L as the primary separation causing members act on the force catching first portions 32*a*R and 32*a*L, putting the cartridge 7 into the first state of separation. The separation causing members 42R and 42L are the auxiliary separation causing members that put the cartridge 7 into the second state of separation.

Referring to FIG. 3(*a*), the apparatus main assembly 100 is provided with the pair of separation causing members 8R and 8L, which are in the form of an eccentric cam. The separation causing members 8R and 8L are for separating and keeping separated the development roller 25 from the photosensitive drum 1, and are attached to the apparatus main assembly so that they can be rotated together by a separation causing member cam drive shaft 43. The separation causing members 8R and 8L are enabled to assume a first position shown in FIG. 4(*b*), and a second position shown in FIG. 4(*c*). The second position is the position into which the separation causing members 8R and 8L are retracted from the first position shown in FIG. 4(*c*). The first position is the position in which the separation causing members 8R and BL keep the electrophotographic photosensitive drum and development roller separated from each other, and the second position is the position in which the separation causing members 8R and 8L allow the electrophotographic photosensitive drum and development roller to be in contact with each other.

To the separation causing members 8R and 8L, the separation causing auxiliary members 42R and 42L for separating and keeping separated the charge roller 2 from the photosensitive drum 1 are rotatably attached.

The separation causing auxiliary members 42R and 42L are designed so that they can be rotated into a third position in which they project beyond the portions of the peripheral edges of the separation causing members 8R and 8L, respectively, which are farthest from the axial line of the separation causing member drive shaft 43, and a fourth position in which they do not project beyond the abovementioned portions of the peripheral edges of the separation causing members 8R and 8L, respectively. In other words, when the separation causing auxiliary members 42R and 42L are in the fourth position, the separation causing auxiliary members 42R and 42L are on the inward of the peripheral edges of the separation causing members 8R and 8L, in terms of the radius direction of the separation causing member drive shaft 43; the fourth position is the position into which the separation causing auxiliary members 42R and 42L are retracted from the third position.

Referring to FIG. 3(*c*), the separation causing member 8R is provided with a shaft hole 8*e*R, and the separation causing auxiliary member 42R is provided with a shaft 42*a*which is an integral part of the separation causing auxiliary member 42R.

Further, the shaft 42*a*is provided with a claw 42*b*R. Thus, the separation causing auxiliary member 42R is attached to the separation causing member 8R by inserting the shaft 42*a*R into the shaft hole 8*e*R, and then, causing the claw 42*b*R to hook onto the separation causing member 8R to prevent the shaft 42*a*R from coming out of the shaft hole 8*e*R of the separation causing member 8R.

Further, the separation causing member drive shaft 43 is inserted into the drive shaft attachment hole 8*f*R of the separation causing member 8R, and then, the separation causing member 8R and separation causing member driver shaft 43 are locked with each other by a pin 45.

As for the separation causing member and separation causing auxiliary member located on the opposite side of the apparatus main assembly in terms of the lengthwise direction of the separation causing member drive shaft 43, that is, the separation causing member 8L and separation causing auxiliary member 42L, they are attached to the separation causing member drive shaft 43 and separation causing member 8L, respectively, in a manner similar to the above described manner in which the separation causing member 8R and separation causing auxiliary member 42R are attached.

(Separation of Development Roller and Charge Roller from Photosensitive Drum)

Referring to FIG. 3(*a*), as the separation causing members 8R and 8L are rotated in the direction indicated by an arrow mark E about the drive shaft 43, the force catching first portions 32*a*R and 32*a*L, with which the side covers 32R and 32L of the development unit 4 are provided, respectively, are changed in attitude, causing the development unit 4 to pivot around the shaft 37 (37L) as the pivotal axle. As a result, the development roller 25 is separated from the photosensitive drum 1 as shown in FIG. 4(*b*).

To describe in more detail the positional relationship among the components for separating and keeping separated the development roller 25 from the photosensitive drum 1, referring to FIG. 3(*b*), the force catching first portion 32*a*R is positioned so that it opposes the separation causing member 8R, and the force catching second portion 32*c*R is positioned so that it opposes the separation causing auxiliary member 42R. In other words, the force catching second portion 32*c*R and force catching first portion 32*a*R are positioned so that they are different in position in terms of the lengthwise direction of the drive shaft 43. More specifically, the force catching first portion 32*a*R and force catching second portion 32*c*R are two different portions of an outward extension of the side cover 32R, in terms of the lengthwise direction. As for the force catching second and first portions 32*c*L and 32*a*L, respectively, they are also rendered different in position in terms of the lengthwise direction of the drive shaft 43 as are their above described counterparts on the opposite end of the cartridge 7.

Described next will be the separation of the charge roller 2 from the photosensitive drum 1. Referring to FIG. 3(*a*), as the separation causing members 8R and 8L are rotated in the direction indicated by an arrow mark E, with the force catching second portions 32*c*R and 32*c*L of the development unit 4 remaining in contact with the separation causing auxiliary members 42R and 42L, respectively, which are in the third position in which they project beyond the farthest portions of the peripheral edges of the separation causing members 8R and 8L from the axial line of the drive shaft 43, the development unit 4 is further pivoted from the position in which only the development roller 25 has been separated from the photosensitive drum 1. As a result, the charge roller 2 is separated from the photosensitive drum 1. When the separation causing auxiliary members 42R and 42L are in the third position, the separation causing members 8R and 8L are not in contact with the force catching first portions 32*a*R and 32*a*L, respectively. Therefore, as long as the cartridge 7 is kept in the above described condition, the separation causing members 8R and 8L, and the force catching first portions 32*a*R and 32*a*L do not sustain damage, even if the cartridge 7 is transported in the apparatus main assembly 100. The separation causing auxiliary members 42R and 42L remain in contact with the force catching second portions 32*c*R and 32*c*L, respectively. However, the separation causing auxiliary members 42R and 42L are provided to be used only when the cartridge 7 is transported in the apparatus main assembly 100. Therefore, allowing the separation causing auxiliary members 42R and 42L to be in contact with the force catching second portions 32*c*R and 32*c*L does not create any problem.

Figure 4:
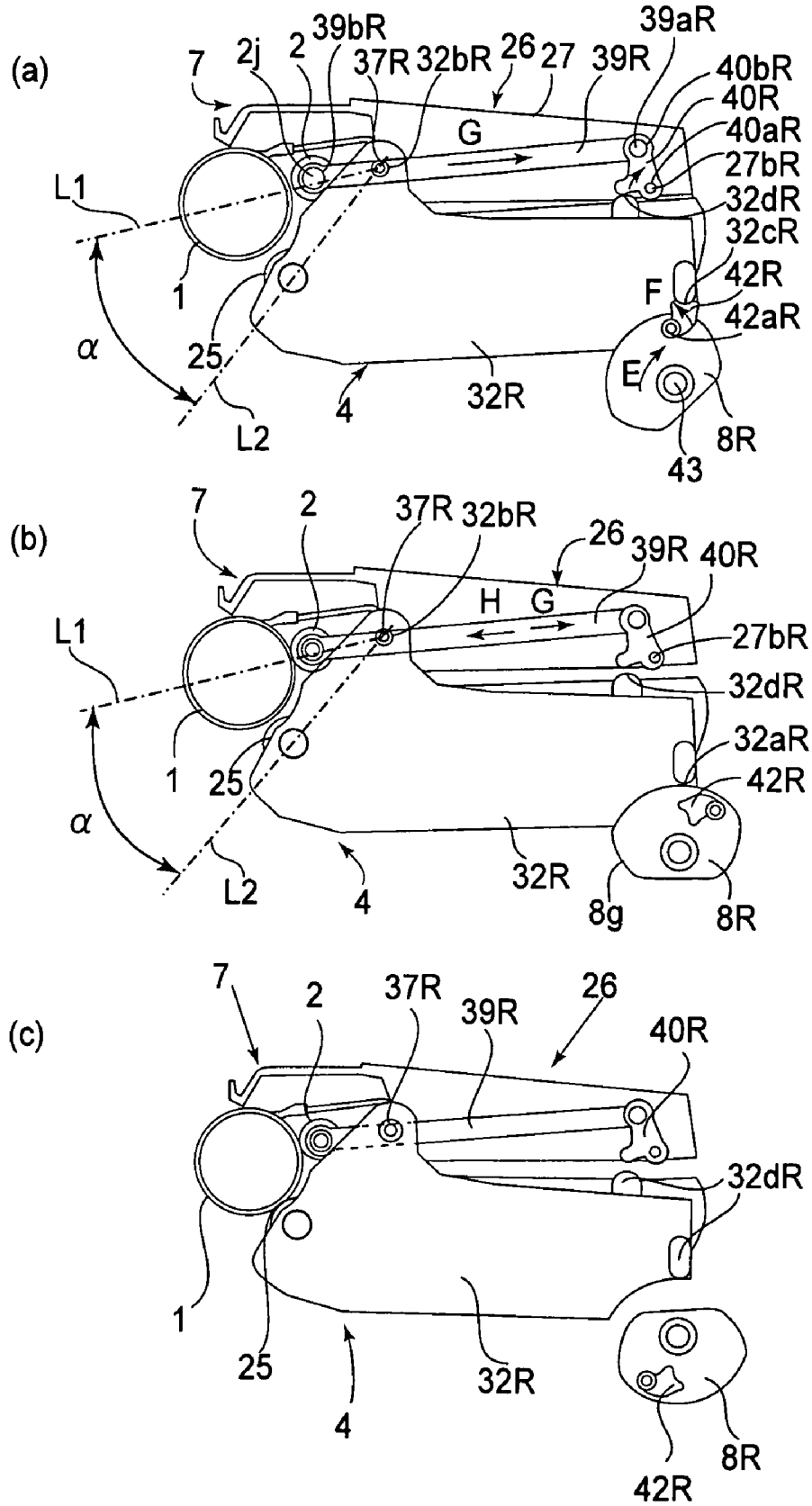
FIG. 4 is a side view of the cartridge in the first embodiment, showing the operation for separating the developing member from the photosensitive drum, and the operation for separating the charging member from the photosensitive drum.

To more concretely describe this subject, referring to FIG. 4(*a*), the photosensitive member unit 26 is provided with a lever 40R, which is attached to the photosensitive member unit 26, with the a shaft 27*b*R, which is an integral part of the cleaning means frame 27 of the photosensitive member unit 26, inserted in the hole 40*a*R of the lever 40R, so that the lever 40R is allowed to rotate about the shaft 27*b*.

A shaft 39*a*R which is an integral part of the charge roller separating member 39R, is rotatably fitted in the lever attachment hole 40*b*R of the member 40R. In the charge roller attachment hole 39*b*R, with which the charge roller separating member 39R is provided, the shaft 2*j* of the charge roller 2 is inserted.

Incidentally, in FIG. 4, only one of the lengthwise ends of the cartridge 7 is shown, although the other lengthwise end of the cartridge 7 is also provided with a lever (40L) and a charge roller separating member (39L), which are similar to the lever 40R and charge roller separating member 39R, and are similarly attached thereto.

In FIG. 4(*a*), the separation causing auxiliary member 42R of the separation causing member 8R is in contact with the force catching second portion 32*c*R of the side cover 32R. When the cartridge 7 is in this condition, the development unit 4 is allowed to pivotally move relative to the photosensitive member unit 26; it is allowed to pivot about the shaft 37R put through the hole 32*b*R. Thus, as the separation causing member 8R is rotated while the cartridge 7 is in this condition, a pressure applying portion 32*d*R, which is an integral part of the side cover 32R of the development unit 4, pushes upward the lever 40R, as a part of the charge roller moving mechanism, which is connected to the charge roller separating member 39R. As a result, the lever 40R is rotated about the shaft 27*b*R in the direction indicated by an arrow mark J, being thereby caused to pull the charge roller separating member 39R in the direction indicated by an arrow mark G. Therefore, the charge roller 2 is separated from the photosensitive drum 1.

Hereinafter, the angle by which the development unit 4 is pivotally moved to separate the charge roller 2 from the photosensitive drum 1 by causing the separation causing auxiliary member 42R to push up the force catching second portion 32*c*R will be referred to as the first angle, whereas the angle by which the development unit 4 is pivotally moved to separate the development roller 25 from the photosensitive drum 1 by causing the separation causing member 8R to push up the force catching first portion 32*a*R will be referred to as the second angle. As described above, the first angle is greater than the second angle. Therefore, as the charge roller 2 is separated from the photosensitive drum 1, the development roller 25 is also separated from the photosensitive drum 1 (second state of separation).

Regarding the condition in which the image forming apparatus in this embodiment is shipped, the cartridge 7 is shipped in the apparatus main assembly 100, being kept in the second state of separation, shown in FIG. 4(*a*), in which the charge roller 2 and development roller 25 are not in contact with the photosensitive drum 1. Mounting the cartridge 7 into the apparatus main assembly 100 of the image forming apparatus before placing the cartridge 7 and main assembly 100 into the same box for shipment can reduce the image forming apparatus in the amount of packaging supplies and the space required for the shipment. Further, in the case of the cartridge 7 in this embodiment, neither the development roller 25 nor the charge roller 2 remains pressed upon the photosensitive drum 1. Therefore, even if the length of time the cartridge 7 is kept in storage prior to its shipment is substantial, no deformation occurs to these rollers 25 and 2, and further, the separation causing members 8R and 8L, and the force catching first portions 32*a*R and 32*a*L, do not sustain damage; it does not occur that they are damaged by impacts which occur while image forming apparatus is transported.

As the image forming apparatus is used for the first time after its shipment, the above described separation causing means is activated, causing the separation causing member 8R to rotate about the drive shaft 43 in the direction indicated by the arrow mark E. As a result, the separation causing auxiliary member 42R is rotated about the shaft 42*a*R in the direction indicated by an arrow mark F, disengaging itself from the force catching second portion 32*c*R.

As the separation causing auxiliary member 42R is rotated as described above, it rotates into the area on the inward side of the peripheral edge 8*b* of the separation causing member 8R. Through the above described process, the development unit 4 pivotally moves relative to the photosensitive member unit 26 (it pivots about the shaft 37R in the hole 32*b*R), causing thereby the force catching first portion 32*a*R of the frame portion 32R to come into contact with the peripheral edge 8*g* of the separation causing member 8R.

Also during the above described process, the pressure applying portion 32*d*R is caused to move away from the lever 40R. As a result, the force which was pulling the charge roller separating member 39R in the direction indicated by the arrow mark G is eliminated, allowing the charge roller separating member 39R to be moved in the direction indicated by the arrow mark H by the force from a charge roller pressing member 46 (FIG. 2) for pressing the charge roller 2 upon the photosensitive drum 1. Consequently, the charge roller 2 comes into contact with the photosensitive drum 1. At this point in time, in the apparatus main assembly 100, the development roller 25 still remains separated from the photosensitive drum 1; the cartridge 7 is in the first state of separation.

Thereafter, the development roller 25 can be placed in contact with, or moved further away from, the photosensitive drum 1 by rotating the separation causing member 8R. The separation causing member 8R, separation causing auxiliary member 42R and force catching second portion 32*c*R are structured so that once the development roller 25 and charge roller 2 are allowed to come into contact with the photosensitive drum 1, the separation causing auxiliary member 42R never returns to the third position in which it remains in contact with the force catching second portion 32*c*R, even if the separation causing member 8R is further rotated. For example, a spring or the like for keeping the separation causing auxiliary member 42R pressed in a specific direction may be provided to prevented separation causing auxiliary member 42R from returning to the third position.

After the apparatus main assembly 100 begins to be used (for image formation), the charge roller 2 remains in contact with the photosensitive drum 1. However, the development roller 25 can be kept separated from the photosensitive drum 1 as fits. That is, the service life of the development roller 25 can be extended by keeping the development roller 25 separated from the photosensitive drum 1 while the development roller 25 is not involved in an image forming operation. The angle (second angle) by which the development unit 4 is to be pivotally moved relative to the photosensitive member unit 26 to place the development roller 25 in contact with the photosensitive drum 1, or to separate from the photosensitive drum 1, is smaller than the angle (first angle) by which the development unit 4 is to be moved relative to the photosensitive member unit 26 to separate the charge roller 2 from the photosensitive drum 1. In other words, referring to FIGS. 4(*a*) and 4(*b*), the angle a between line L1 connecting the axial line of the shaft 37R and the axial line of the photosensitive member unit 26, and line L2 connecting the axial line of the shaft 37R and the axial line of the development roller 25, is smaller when the cartridge 7 is in the first state of separation than when the cartridge 7 is in the second state of separation. Therefore, the development roller 25 can be smoothly placed in contact with the photosensitive drum 1, or can be smoothly separated from the photosensitive drum 1.

In order to ensure that the charge roller 2 is separated from the photosensitive drum 1 across the entire lengthwise range of the charge roller 2, the above described lever, charge roller separating member, etc., are also located at the other lengthwise end of the charge roller 2, and are made to move in the same manner as the above described lever, charge roller separating member, etc., are made to move.

As described above, the angle (first angle) by which the development unit 4 is made to pivotally move in order to separate the charge roller 2 from the photosensitive drum 1 by causing the separation causing auxiliary member 42R to push up the force catching second portion 32*c*R is greater than the angle (second angle) by which the development unit 4 is made to pivotally move in order to separate the development roller 25 from the photosensitive drum 1 by causing the separation causing member 8R to push up the force catching first portion 32*a*R. Therefore, the charge roller 2 can be separated from the photosensitive drum 1.

Also as described above, when the separation causing auxiliary members 42R and 42L are in the third position, the separation causing members 8R and 8L are not in contact with the force catching first portions 32*a*R and 32*a*L. Thus, as long as the separation causing auxiliary members 42R and 42L are kept in the third position, not only the photosensitive drum 1 and development roller 25, but also, the separation causing members 8R and 8L and the force catching first portions 32*a*R and 32*a*L, can be protected from the shocks or the like which occur while the cartridge 7 is transported, even if the cartridge 7 is transported in the apparatus main assembly 100.

Further, the separation causing auxiliary members 42R and 42L for keeping the charge roller 2 separated from the photosensitive drum 1, and the separation causing members 8R and 8L for separating and keeping separated the development roller 25 from the photosensitive drum 1, are provided on the main assembly side of the image forming apparatus, whereas the force catching first and second portions are provided on the cartridge side, more specifically, the development unit side of the cartridge 7, so that they correspond in position to the separation causing members 8R and 8L and the separation causing auxiliary members 42R and 42L, and also, so that the force catching first and second portions are rendered independent from each other in terms of the force application thereto. Therefore, the separation of the charge roller 2 from the photosensitive drum 1 and the separation of the development roller 25 can be controlled independently from each other to ensure that the charge roller 2 and development roller 25 are separated from the photosensitive drum 1.

Further, when shipping (or simply transporting) the apparatus main assembly 100, with the cartridge 7 mounted in the apparatus main assembly 100, not only the development roller 25 but also the charge roller 2 can be kept separated from the photosensitive drum 1.

Thus, even if the cartridge 7 and apparatus main assembly 100 are shipped in the same box, with the cartridge 7 mounted in the apparatus main assembly 100, the abovementioned components are not going to be deformed, making it therefore possible to provide an image forming apparatus of the plug-and-play type, that is, an image forming apparatus which can be readied for use simply by being connected to an electric power source.

Embodiment 2

Next, referring to FIGS. 5 and 6, the second embodiment of the present invention will be described. The basic structures of the apparatuses in this embodiments are the same as those in the above described first embodiment, and therefore, will not be described to avoid repetition. Hereafter, therefore, only the structural features which characterize this embodiment will be described. Further, the components in this embodiment, which are the same in function as those in the above described embodiment will be given the same referential symbols as those given to the components in the preceding embodiments.

What makes this embodiment different from the first embodiment is that an separation causing auxiliary member retaining means for retaining the separation causing auxiliary member in the fourth position once the separation causing auxiliary member is moved into the fourth position is provided.

To describe more concretely the separation causing auxiliary member retaining means, the separation causing auxiliary members 42 (42R and 42L) are also rotatably attached to the separation causing members 8 (8R and 8L), respectively. Further, the separation causing auxiliary member 42 and separation causing members 8 are designed so that the separation causing auxiliary member 42 is enabled to assume the third position in which they project beyond the portion of the peripheral edge of the corresponding separation causing member 8, which is farthest from the axial line of the separation causing member drive shaft 43, and the fourth position in which they do not project from the abovementioned portion of the peripheral edge of the corresponding separation causing member 8.

Figure 5:
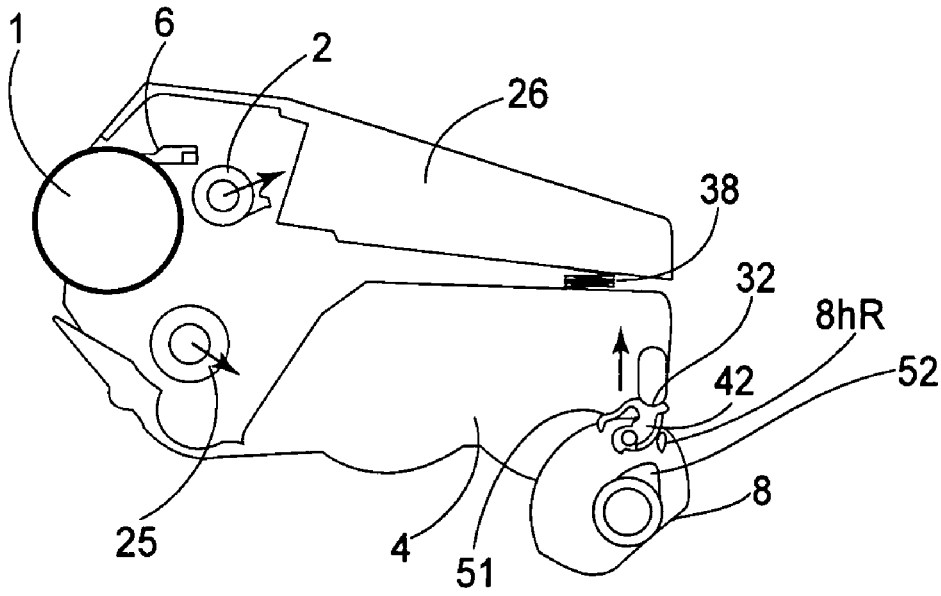
FIG. 5 is a side view of the cartridge in the second embodiment, showing the operation for separating the developing member from the photosensitive drum, and the operation for separating the charging member from the photosensitive drum.
Figure 5:
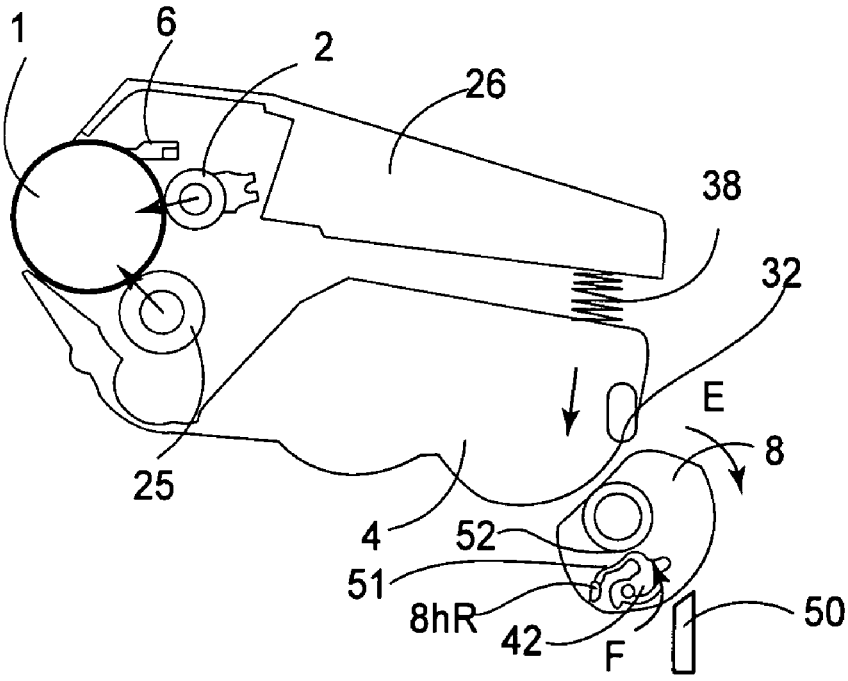
Figure 6:
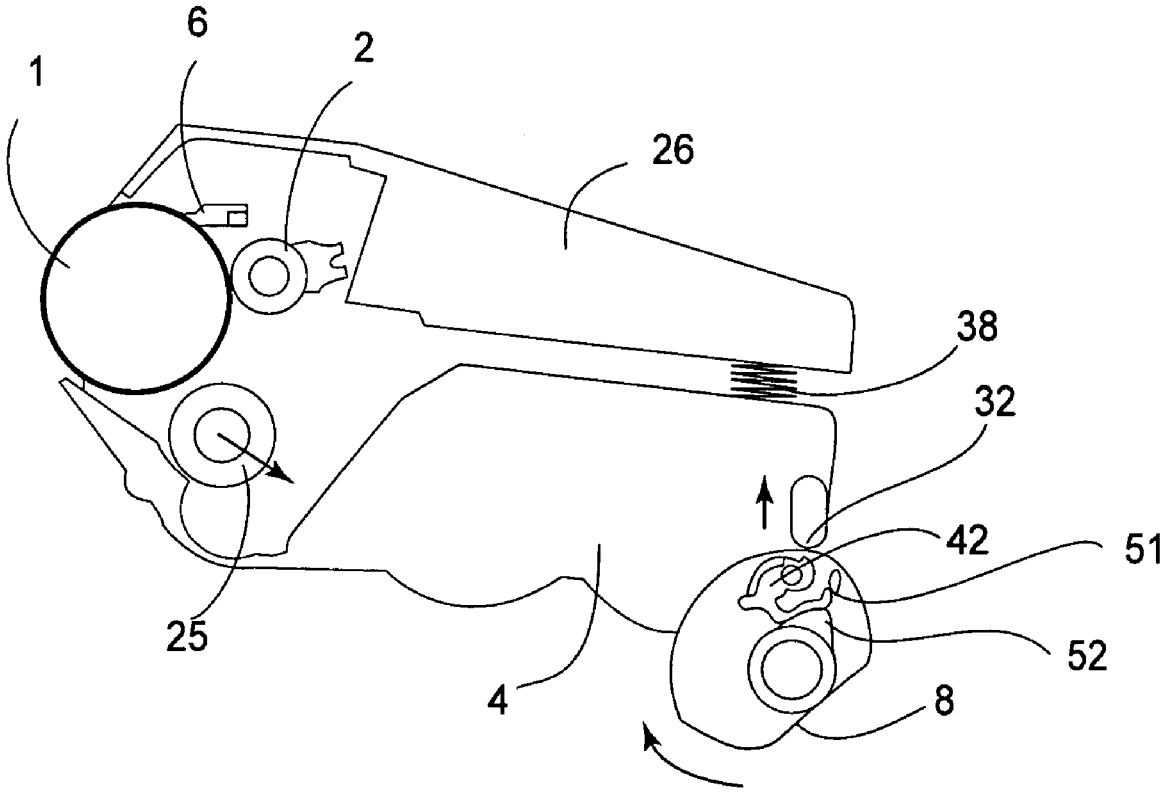
FIG. 6 is a side view of the cartridge in the second embodiment, showing the operation for separating the developing apparatus from the photosensitive drum.

The separation causing member 8R (8L) is provided with a rotation control rib 8*h*R (8*h*L) which prevents the separation causing auxiliary member 42R (42L) from rotating in the clockwise direction in FIG. 5. That is, it is the same direction as the direction in which the cartridge 7 is mounted into the apparatus main assembly 100 that the separation causing auxiliary member 42 is prevented from rotating. Therefore, the cartridge 7 can be mounted into the apparatus main assembly 100 to transport the apparatus main assembly 100 and cartridge 7, with the cartridge 7 mounted in the apparatus main assembly 100. As the separation causing auxiliary member 42 is moved into the third position, the development unit 4 of the cartridge 7 is pushed upward from the position in which the development roller 25 and charge roller 2 are in contact with the photosensitive drum 1, causing the development roller 25 and charge roller 2 to separate from the photosensitive drum 1; when the separation causing auxiliary member 42 is in the third position, the development roller 25 and charge roller 2 are kept separated from the photosensitive drum 1.

Between when the image forming apparatus is turned on for the first time after it was delivered to a user, and when a printing operation is performed for the first time, driving force is transmitted from the main motor (unshown) of the apparatus main assembly 100 to the separation causing member drive shaft 43, causing the separation causing member 8 to rotate in the direction indicated by the arrow mark E in FIG. 5(*b*). As a result, the separation causing auxiliary member 42 comes into contact with an additional regulating member 50 disposed in the apparatus main assembly 100, being thereby caused to rotate in the direction indicated by an arrow mark F in FIG. 5(*b*). Consequently, the an elastic locking member 51, with which the separation causing auxiliary member 42 is provided, is caused to elastically latch onto a claw-shaped projection 52, with which the separation causing member 8 is provided, fixing in attitude the separation causing auxiliary member 42.

In other words, as the separation causing auxiliary member 42 is moved into the fourth position, it is locked in the fourth position by the projection 52 as a means for retaining the separation causing auxiliary member. With the employment of the above described structural arrangement, once the charge roller 2 is allowed to come into contact with the photosensitive drum 1, by the movement of the separation causing means, the separation causing auxiliary member 42 will never move back into the third position, that is, it does not act on the force catching second portion 32 (32*c*R and 32*c*L), even if the separation causing member 8 is rotated an additional full turn.

Thereafter, therefore, it does not occur that as the separation causing member 8 is rotated to place the development roller 25 in contact with the photosensitive drum 1, or to separate the development roller 25 from the photosensitive drum 1, the charge roller 2 becomes separated from the photosensitive drum 1.

Incidentally, the locking member 51 for locking the separation causing auxiliary member 42, which remains in the above described place while assuming the separation causing auxiliary member retaining attitude by being locked with the claw-shaped projection 52 of the separation causing member 8, is elastic. Therefore, it is easy to manually return the separation causing auxiliary member 42 to the third position. Thus, when the image forming apparatus is going to be left unused for a substantial length of time or in the like situation, the separation causing auxiliary members 42 can be manually moved back into the third position to put the cartridge 7 in the second state of separation to prevent the elastic layer of the development roller 25 and the elastic layer of the charge roller 2 from being irreversibly deformed. Obviously, even after the separation causing auxiliary members 42 is manually moved back into the third position, the charge roller 2 can be made to automatically come into contact with the photosensitive drum 1, by rotating the separation causing member 8, when it is necessary to use the image forming apparatus again.

When the separation causing auxiliary members 42R and 42L are in the third position, the separation causing members 8A and 8L are not in contact with the force catching first portions 32*a*R and 32*a*L, as they are in the first embodiment. Therefore, as long as the separation causing auxiliary members 42R and 42L are kept in the third position, not only the photosensitive drum 1 and development roller 25, but also, the separation causing members 8R and 8L and force catching first portions 32$a$R and 32$a$L can be protected from the shocks or the like which occur during the shipment of the image forming apparatus.

Embodiment 3

Next, referring to FIGS. 7 and 8, the apparatuses in the third embodiment will be described. The basic structures of the apparatuses in this embodiment are the same as those in the above described first embodiment, and therefore, will not be described to avoid repetition. Hereafter, therefore, only the structural features which characterize this embodiment will be described. Further, the components in this embodiment, which are the same in function as those in the above described embodiments will be given the same referential symbols as those given to the components in the preceding embodiments.

In the first embodiment described above, the separation causing auxiliary members 42R and 42L were rotatably attached to the separation causing members 8R and 8L, respectively. However, the separation causing auxiliary members 42R and 42L in this embodiment are rendered independent from the separation causing members 8R and 8L. More specifically, referring to FIG. 7($a$), also in this embodiment, the apparatus main assembly 100 is provided with a pair of separation causing members 8R and 8L for separating and keeping separated the development roller 25 from the photosensitive drum 1, and a pair of separation causing auxiliary members 42R and 42L for keeping the charge roller 2 separated from the photosensitive drum 1. In this embodiment, however, they are L-shaped in cross section. As the separation causing members 8R and 8L are moved in the direction indicated by an arrow mark L, they come into contact with, and push, the force catching first portions 32$a$R and 32$a$L, respectively, with which the side covers 32R and 32L of the development unit 4. As a result, the development unit 4 is pivotally moved relative to the photosensitive member unit 26; it is made to pivot about the shaft 37. Consequently, the development roller 25 is separated from the photosensitive drum 1.

Figure 7:
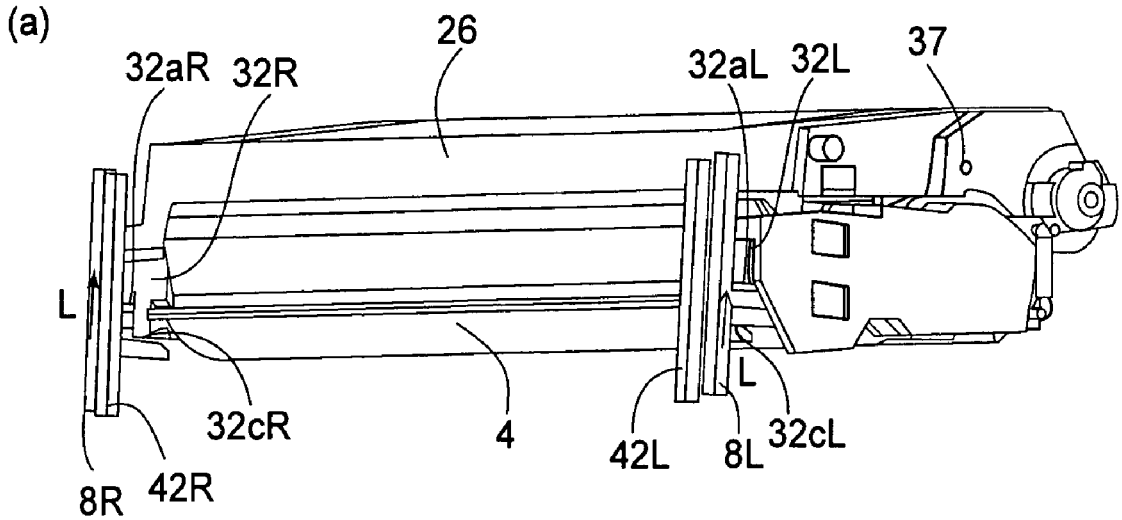
FIG. 7 is a perspective view of the cartridge in the third embodiment, showing the mechanism for separating the developing member and charging member from the photosensitive drum.
Figure 7:
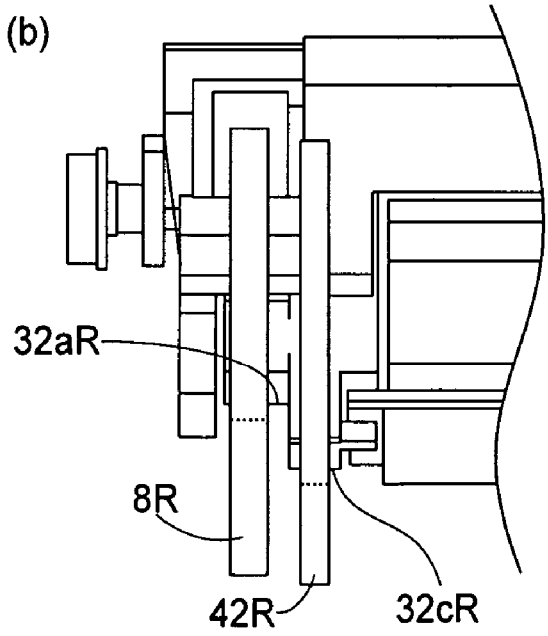

In FIG. 7($a$), the state of the cartridge 7, which has been realized because the development unit 4 has been further pivoted from the position in which only the development roller 25 had been separated from the photosensitive drum 1 as the separation causing auxiliary members 42R and 42L had come in contact with the force catching second portions 32$c$R and 32$c$L of the development unit 4, and pushed them. In other words, FIG. 7($a$) shows the second state of separation of the cartridge 7, that is, the state of separation in which neither the development roller 25 nor charge roller 2 is in contact with the photosensitive drum 1.

To describe in more detail the positional relationship among the components for separating and keeping separated the development roller 25 and/or charge roller 2 from the photosensitive drum 1, referring to FIG. 7($b$), the force catching first portion 32$a$R located at one of the lengthwise ends of the cartridge 7 is positioned so that it opposes the separation causing member 8R, and the force catching second portion 32$c$R is positioned so that it opposes the separation causing auxiliary member 42R. In other words, the force catching second portion 32$c$R and force catching first portion 32$a$R are positioned so that they are different in position in terms of the axial direction of the photosensitive drum. As for the force catching second and first portions 32$c$L and 32$a$L, respectively, located at the other lengthwise end of the cartridge 7, they are also rendered different in position in terms of the axial direction of the photosensitive drum as are their above described counterparts on the opposite lengthwise end of the cartridge 7.

Described next will be the separation of the charge roller from the photosensitive drum. Referring to FIG. 8($a$) in which the separation causing auxiliary member 42R is in contact with the force catching second portion 32$c$R of the side cover 32R. The development unit 4 has pivotally moved relative to the photosensitive member unit 26; it has pivoted about the shaft 37R in the hole 32B of the development unit 4, having thereby caused the pressing portion 32$d$R which is an integral part of the side cover 32R of the development unit 4 to push up the lever 40R connected to the charge roller separating member 39R. As a result, the lever 40R has rotated in the direction indicated by an arrow mark J about the shaft 27$b$R in the hole 40$a$R. Consequently, the charge roller separating member 39R has been pulled in the direction indicated by an arrow mark G, separating thereby the charge roller 2 from the photosensitive drum 1, that is, placing the cartridge 7 in the second state of separation, in which the development roller 25 has already been separated from the photosensitive drum 1.

Regarding the condition in which the image forming apparatus in this embodiment is shipped, the cartridge 7 is shipped in the apparatus main assembly 100, being kept in the state of separation, shown in FIG. 4($a$), in which the charge roller 2 is kept separated from the photosensitive drum 1.

Figure 8:
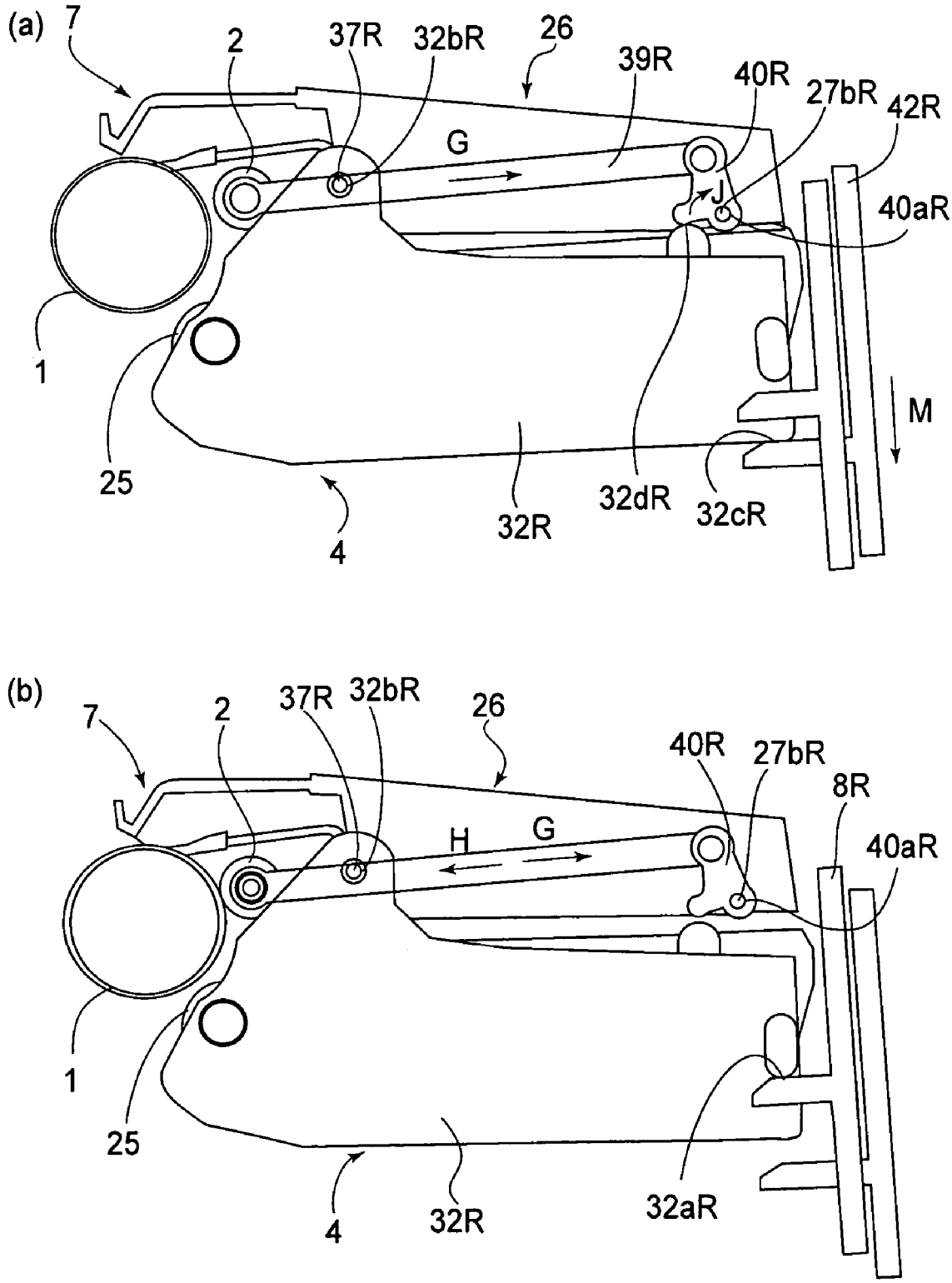
FIG. 8 is a side view of the cartridge in the third embodiment, showing the operation for separating the developing member from the photosensitive drum, and the operation for separating the charging member from the photosensitive drum.

As the image forming apparatus is used for the first time after its shipment, the separation causing auxiliary member 42R moves in the direction indicated by the arrow mark M in FIG. 8, separating from the force catching second portion 32$c$R. As a result, the development unit 4 pivotally moves about the shaft 37R in the hole 32$b$R; it moves relative to the photosensitive member unit 26. Consequently, the force catching portion 32$a$R of the side cover 32R comes into contact with the separation causing member 8R, and also, the pressing portion 32$d$R separates from the lever 40R, eliminating the force which was acting in the direction to pull the charger roller separating member 39R in the direction indicated by the arrow mark G. Therefore, the charge roller separating member 39R is pulled in the direction indicated by the arrow mark H by the force generated by the unshown charging member pressing compression spring for keeping the charge roller 2 upon the photosensitive drum 1. Consequently, the charge roller 2 is pressed upon the photosensitive drum 1. Therefore, between when the image forming apparatus is turned on for the first time after it was delivered to a user, and when a printing operation is performed for the first time, only the development roller 25 is not in contact with the photosensitive drum 1; the cartridge 7 is in the first state of separation.

As described above, when the separation causing auxiliary members 42R and 42L are in the third position, the separation causing members 8R and 8L are not in contact with the force catching first portions 32$a$R and 32$a$L, respectively. Therefore, even if the cartridge 7 is transported in the apparatus main assembly 100, as long as the separation causing auxiliary members 42R and 42L are kept in the third position, not only the photosensitive drum 1 and development roller 25, but also, the separation causing members 8R and 8L and the force catching first portions 32$a$R and 32$a$L, can be protected from the shocks or the like which occur while the cartridge 7 is transported.

Further, the apparatus main assembly 100 is provided with the separation causing auxiliary members 42R and 42L for keeping the charge roller 2 separated from the photosensitive drum 1, and the separation causing members 8R and 8L for separating and keeping separated the development roller 25 from the photosensitive drum 1, and the development unit 4 of the cartridge 7 is provided with the force catching second portions 32$c$R and 32$c$L and the force catching first portions

32*a*R and 32*a*L, which are disposed so that they correspond in position to the separation causing auxiliary members 42R and 42L and the separation causing members 8R and 8L, respectively, and also, so that the force catching first and second portions are rendered independent from each other in terms of the force applied thereto. Therefore, the separation of the charge roller 2 from the photosensitive drum 1 and the separation of the development roller 25 can be controlled independently from each other to ensure that the charge roller 2 and development roller 25 are separated from the photosensitive drum 1 as fits. Further, when shipping (or simply transporting) the apparatus main assembly 100 in the same box, with the cartridge 7 mounted in the apparatus main assembly 100, not only the development roller 25 but also the charge roller 2 can be separated from the photosensitive drum 1.

Thus, even if the cartridge 7 and apparatus main assembly 100 are shipped in the same box, with the cartridge 7 mounted in the apparatus main assembly 100, the abovementioned components are not going to be deformed, making it therefore possible to provide an image forming apparatus of the plug-and-play type, that is, an image forming apparatus which can be readied for use simply by being connected to an electric power source, without employing a complicated structural arrangement.

The present invention can protect the electrophotographic photosensitive drum, development roller, and force catching first portions and first retaining member for separating the development roller from the electrophotographic photosensitive drum, while an electrophotographic image forming apparatus is transported, with a process cartridge mounted in the image forming apparatus main assembly.

The present invention can protect the electrophotographic photosensitive drum and development roller of a process cartridge, when the image forming apparatus is transported with the process cartridge mounted in the apparatus main assembly.

The present invention makes it possible to transport an image forming apparatus, with a process cartridge mounted in the apparatus main assembly, without increasing the apparatus in size. Therefore, not only can the present invention reduce an electrophotographic image forming apparatus in the cost of the material for packaging the apparatus for transportation, but also, it can improve the apparatus in transportation efficiency.

The present invention makes it possible for the charge roller and development roller of a process cartridge to be quickly, reliably, and individually separated from the photosensitive drum of the process cartridge, while the process cartridge is in the electrophotographic image forming apparatus main assembly.

Further, the present invention makes it possible for the charging member in a process cartridge to be separated from the photosensitive drum in the process cartridge, even when the process cartridge is in the main assembly of an electrophotographic image forming apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 078770/2005 filed Mar. 18, 2005 which is hereby incorporated by reference.

What is claimed is:

1. A process cartridge detachably mountable to a main assembly of an electrophotographic image forming apparatus, the electrophotographic image forming apparatus including a first engageable member movable between a first position and a second position retracted from the first position and a second engageable member movable between a third position and a fourth position retracted from the third position, said process cartridge being transportable while being in a mounted state in the main assembly of the electrophotographic image forming apparatus, said process cartridge comprising:

an electrophotographic photosensitive drum;

a developing roller that develops an electrostatic latent image formed on said electrophotographic photosensitive drum;

a first frame supporting said electrophotographic photosensitive drum;

a second frame supporting said developing roller, said second frame being movably connected with said first frame;

a first force receiving portion that receives, from the first engageable member, a force for separating said electrophotographic photosensitive drum and said developing roller from each other by contacting to the first engageable member, when said process cartridge is mounted to the main assembly of the electrophotographic image forming apparatus, and the first engageable member is placed at the first position;

a second force receiving portion that maintains said electrophotographic photosensitive drum and said developing roller spaced from each other and that receives a force, from the second engageable member, for separating the first engageable member and said first force receiving portion from each other by contacting said second engageable member when said process cartridge is mounted to the main assembly of the electrophotographic image forming apparatus, and the second engageable member is placed at said third position;

wherein when said process cartridge is transported while being in a mounted state in said main assembly of the electrophotographic image forming apparatus, said second force receiving portion receives a force for separating the first engageable member and said first force receiving portion from each other from the second engageable member, and wherein said first force receiving portion and said second force receiving portion are disposed at the positions which are different from each other.

2. A process cartridge according to claim 1, further comprising:

a charging roller that electrically charges said electrophotographic photosensitive drum; and a spacer member that spaces said electrophotographic photosensitive drum and said charging roller from each other when said process cartridge is mounted to the main assembly of the electrophotographic image forming apparatus, and the second engageable member is placed at the third position.

3. A process cartridge according to claim 2, wherein said charging roller and said spacer member are provided on said first frame, and by contact of said second force receiving portion to the second engageable member, an urging portion provided on said second frame is contacted to said spacer member to space said charging roller from said electrophotographic photosensitive drum.

4. A process cartridge according to claim 1, wherein said first force receiving portion and said second force receiving portion are provided at one and the other ends of said second frame with respect to a longitudinal direction of said process cartridge, respectively.

5. A process cartridge according to claim 4, wherein said first force receiving portion and said second force receiving portion are provided on projections projected from said second frame in the longitudinal direction, respectively.

6. An electrophotographic image forming apparatus for forming an image on a recording material to which a process cartridge is detachably mountable, wherein electrophotographic image forming apparatus is transportable with the process cartridge mounted thereto, said apparatus comprising:

(1) a first engageable member movable between a first position and a second position retracted from the first position;

(2) a second engageable member movable between a third position and a fourth position retracted from the third position;

(3) a mounting member that demountably mounts the process cartridge including:

an electrophotographic photosensitive drum;

a developing roller that develops an electrostatic latent image formed on the electrophotographic photosensitive drum;

a first frame supporting the electrophotographic photosensitive drum;

a second frame supporting the developing roller, the second frame being movably connected with the first frame;

a first force receiving portion that receives, from said first engageable member, a force for separating the electrophotographic photosensitive drum and the developing roller from each other by contacting to said first engageable member, when the process cartridge is mounted to the main assembly of said electrophotographic image forming apparatus, and said first engageable member is placed at the first position;

a second force receiving portion that maintains the electrophotographic photosensitive drum and the developing roller spaced from each other and for receiving a force, from said second engageable member, for separating said first engageable member and the first force receiving portion from each other by contacting said second engageable member when the process cartridge is mounted to the main assembly of the electrophotographic image forming apparatus, and said second engageable member is placed at the third position;

wherein when the process cartridge is transported while being in a mounted state in said main assembly of said electrophotographic image forming apparatus, said second engageable member is placed at said third position, and wherein the first force receiving portion and the second force receiving portion are disposed at the positions which are different from each other.

7. An apparatus according to claim 6, wherein the process cartridge further includes:

a charging roller that electrically charges the electrophotographic photosensitive drum; and a spacer member that spaces the electrophotographic photosensitive drum and the charging roller from each other when the process cartridge is mounted to the main assembly of said electrophotographic image forming apparatus, and said second engageable member is placed at the third position.

8. An apparatus according to claim 7, wherein the charging roller and the spacer member are provided on the first frame, and by contact of the second force receiving portion to said second engageable member, an urging portion provided on the second frame is contacted to the spacer member to space the charging roller from the electrophotographic photosensitive drum.

9. An apparatus according to claim 6, wherein the first force receiving portion and the second force receiving portion are provided at one and the other ends of the second frame with respect to a longitudinal direction of the process cartridge, respectively.

10. An apparatus according to claim 9, wherein the first force receiving portion and the second force receiving portion are provided on projections projected from the second frame in the longitudinal direction, respectively.

* * * * *